United States Patent [19]

Sakoda et al.

[11] 4,450,344

[45] May 22, 1984

[54] DAMPER DRIVE SYSTEM IN A COMBINED MICROWAVE AND ELECTRIC HEATER OVEN

[75] Inventors: Yasuhiro Sakoda, Wakayama; Kazuyuki Matsubayashi, Amagasaki, both of Japan

[73] Assignee: Sharp Kabushiki Kaisha, Osaka, Japan

[21] Appl. No.: 346,535

[22] Filed: Feb. 8, 1982

[30] Foreign Application Priority Data

Feb. 12, 1981 [JP] Japan ..... 56-18812[U]

[51] Int. Cl.[3] ..... H05B 6/68

[52] U.S. Cl. ..... 219/400; 219/10.55 B; 219/10.55 R; 126/21 A; 126/285 B; 126/285 R; 110/163; 159/41; 236/1 G; 431/20

[58] Field of Search ..... 219/10.55 B, 10.55 R, 219/10.55 C, 400; 126/21 A, 21 R, 285 R, 285 A, 285 B, 285.5, 293, 295; 110/163; 159/41; 236/1 G; 431/20

[56] References Cited

U.S. PATENT DOCUMENTS 3,773,028 11/1973 Schreibeis ..... 126/285 B
4,189,090 2/1980 Drinkuth ..... 236/1 G
4,240,397 12/1980 Seidel ..... 126/285 B

FOREIGN PATENT DOCUMENTS 54-102640 8/1979 Japan ..... 219/10.55 B

*Primary Examiner*—B. A. Reynolds
*Assistant Examiner*—Philip H. Leung
*Attorney, Agent, or Firm*—Birch, Stewart, Kolasch & Birch

[57] ABSTRACT

A combined microwave and electric heater oven includes a fan system for cooling a magnetron, and a damper for selectively introducing a forced air flow generated by the fan system into an oven cavity. A damper cam is secured to a drive shaft of a damper motor, and a damper link is disposed between the damper cam and the damper to drive the damper. A microswitch is disposed near the damper cam so that the microswitch develops a first detection signal when the damper is tightly closed. In response to the first detection signal, the rotation of the damper motor is terminated to hold the damper in the tightly closed state. The microswitch develops a second detection signal when the damper is placed in the full-open state. In response to the second detection signal, the rotation of the damper motor is terminated to hold the damper in the full-open state.

8 Claims, 3 Drawing Figures

DAMPER DRIVE SYSTEM IN A COMBINED MICROWAVE AND ELECTRIC HEATER OVEN

BACKGROUND AND SUMMARY OF THE INVENTION

The present invention relates to a damper drive system in a combined microwave and electric heater oven for controlling the direction of the forced air flow created by a fan system.

In a combined microwave and electric heater oven, a fan system is provided for cooling a magnetron disposed in a space formed between an oven wall and a housing of the combined microwave and electric heater oven. The forced air flow created by the fan system is introduced into the oven cavity for discharging the gas generated in the oven cavity during the microwave cooking operation. The air flow must not be introduced into the oven cavity during the electric heater cooking operation, because the interior of the oven cavity must be maintained at a high temperature during the electric heater cooking operation. However, even during the electric heater cooking operation, the fan system is continuously operated in order to protect the magnetron from the high temperature generated by the electric heater.

Therefore, a damper mechanism is normally provided in the combined microwave and electric heater oven for selectively introducing the forced air flow into the oven cavity. A typical construction of the combined microwave and electric heater oven including a damper mechansim is described in copending application Ser. No. 138,749, "DAMPER ACTIVATION IN A COMBINED MICROWAVE AND ELECTRIC HEATING OVEN", filed on Apr. 9, 1980 by Yasuo Shin now U.S. Pat. No. 4,369,347, patented Jan. 18, 1983 and assigned to the same assignee as the present invention.

Accordingly, an object of the present invention is to provide a novel damper drive system in a combined microwave and electric heater oven.

Another object of the present invention is to simplify a damper drive mechanism in a combined microwave and electric heater oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a motor is provided to open or close the damper. A relay switch mechanism is provided for energizing the motor at a desired time. A detection system is associated with the damper, which develops a detection signal when the damper is completely opened or when the damper is completely closed. In response to the thus developed detection signal, the relay switch mechanism is turned off, thereby deenergizing the motor.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIGS. 2 and 3 are schematic plan views showing an operation mode of the damper drive system of the present invention, wherein FIG. 2 shows an opened condition, and FIG. 3 shows a closed condition.

DESCRIPTION OF THE PREFERRED EMBODIMENTS

Figure 1:
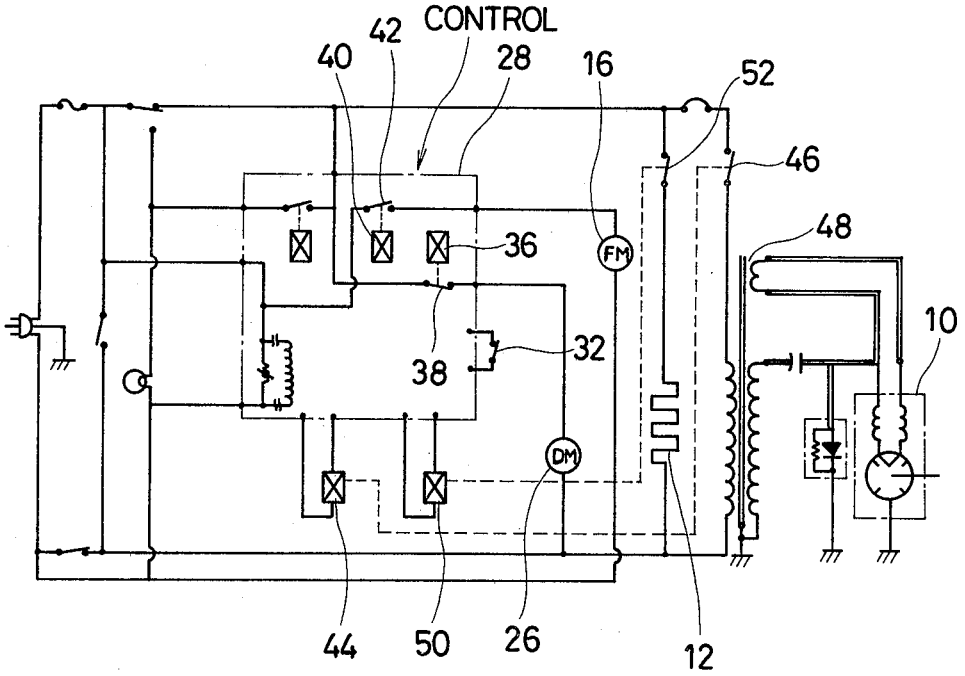
FIG. 1 is a block diagram of a combined microwave and electric heater oven employing an embodiment of a damper drive system of the present invention.

As illustrated in FIG. 1, a combined microwave and electric heater oven generally comprises a magnetron 10 for conducting the microwave cooking operation. The magnetron 10 is disposed in a space provided between the oven cavity wall and the housing of the combined microwave and electric heater oven. In addition, an electric heater 12 is disposed in an oven cavity 14 for conducting the electric heater cooking. A fan motor 16 is associated with a cooling fan 18 in order to create a forced air flow 20 in the above-mentioned space, thereby cooling the magnetron 10. A damper 22 is provided for selectively introducing the forced air flow 20 into the oven cavity 14. More specifically, in the microwave cooking operation mode wherein the magnetron 10 is energized, the damper 22 is opened in order to introduce the forced air flow 20 into the oven cavity 14. In the electric heater cooking operation mode, the damper 22 is closed in order not to introduce the forced air flow 20 into the oven cavity 14.

The damper 22 is driven to open or close an aperture 24 by means of a damper motor 26. A control unit 28 controls the activation of the damper motor 26. The control unit 28 further controls the energization of the magnetron 10, the electric heater 12 and the fan motor 16.

Figure 2:
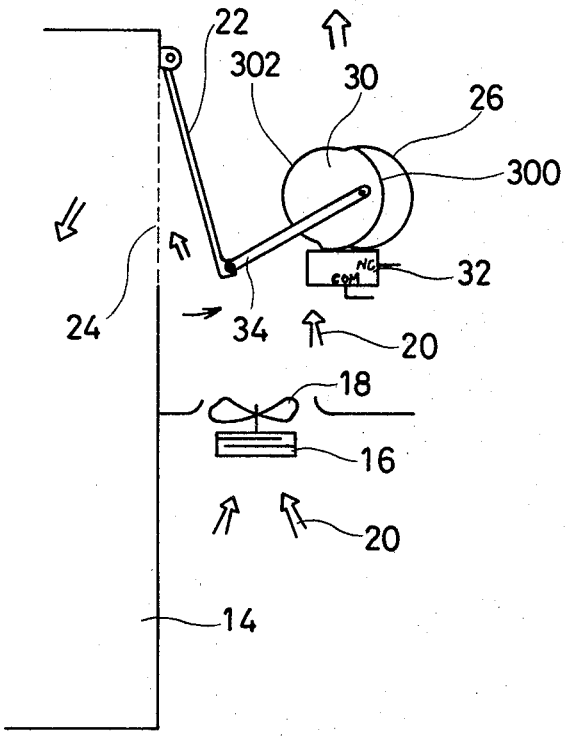
Figure 3:
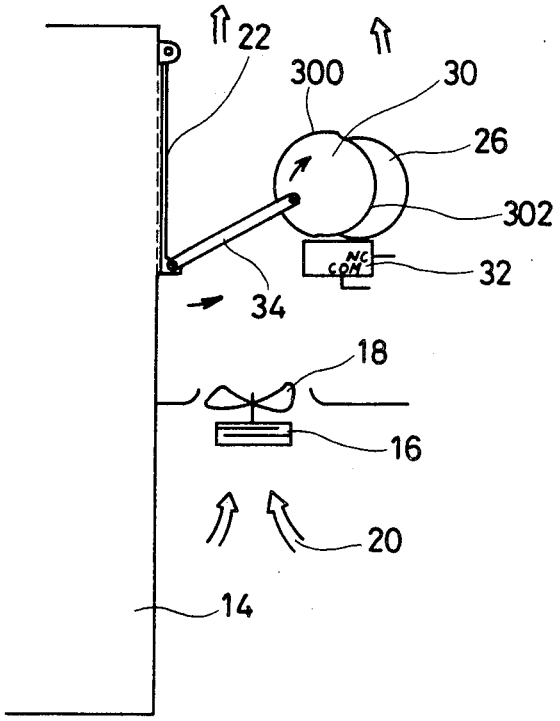

As illustrated in FIGS. 2 and 3, a damper cam 30 is secured to a shaft of the damper motor 26. The damper cam 30 has a large diameter semicircular portion 300 and a small diameter semicircular portion 302. A normally closed microswitch 32 is disposed near the damper cam 30 in such a manner that the actuator of the microswitch 32 is depressed by the large diameter semicircular portion 300, whereby the microswitch 32 is switched off when the large diameter semicircular portion 300 faces the microswitch 32. A damper link 34 is connected between the free end of the damper 22 and the damper cam 30 for transferring the rotation of the damper motor 26 to the damper 22.

The operation mode of the combined microwave and electric heater oven of the present invention is as follows:

To perform the microwave cooking operation, the microwave cooking mode switch is actuated to introduce the microwave mode signal into the control unit 28. The control unit 28 develops a control signal to activate a first relay 36, thereby closing a relay contact 38. In response thereto, the damper motor 26 is supplied with power to open the damper 22. The rotation of the damper motor 26 is transferred to the damper 22 via the damper cam 30 and the damper link 34. When the damper 22 is placed in the full-opened condition, the large diameter semicircular portion 300 contacts the actuator of the normally closed microswitch 32 as shown in FIG. 2. The microswitch 32 is switched off. The trailing edge of the switching operation of the microswitch 32 is detected by the control unit 28 which develops a control signal to deenergize the first relay 36. Accordingly, the power supply to the damper motor 26 is terminated for holding the damper 22 at the open state.

Under these conditions, when the cook start switch is actuated, a second relay 40 is energized to close a relay contact 42 for activating the fan motor 16. The forced air flow 20 is created by the cooling fan 18. Since the damper 22 is held in the open state, a portion of the forced air flow 20 is introduced into the oven cavity 14. Further, a third relay 44 is energized in order to activate the magnetron 10 via a relay contact 46 and a transformer 48.

To perform the electric heater cooking operation, the electric heater cooking mode switch is actuated to introduce the electric heater mode signal into the control unit 28. The control unit 28 develops a control signal to activate the first relay 36, thereby closing the relay contact 38. The damper motor 26 rotates to close the damper 22. The rotation of the damper motor 26 is transferred to the damper 22 via the damper cam 30 and the damper link 34. When the damper 22 is placed in the tight-close condition, the small diameter semicircular portion 302 faces the normally closed microswitch 32 as shown in FIG. 3. The microswitch 32 is switched on, and the leading edge of the switching operation of the microswitch 32 is detected by the control unit 28. The control unit 28 develops the control signal to deenergize the first relay 36, whereby the relay contact 38 is switched off. The rotation of the damper motor 26 is terminated so that the damper 22 is held at the closed condition.

Under these conditions, when the cook start switch is actuated, the second relay 40 is activated to close the relay contact 42. The fan motor 16 is energized to generate the forced air flow 20 through the use of the cooling fan 18. The thus created forced air flow 20 is not introduced into the oven cavity 14 because the damper 22 is closed. Further, a fourth relay 50 is energized to supply power to the electric heater 12 through a relay contact 52.

The control unit 28 is preferably implemented with an LSI model No. M58841-024SP manufactured by Mitsubishi Denki Kabushiki Kaisha.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking apparatus comprising:

an oven cavity defined by an oven wall, said oven wall having an aperture formed therein;

fan means for creating a forced air flow along an outer surface of said oven wall in such a manner that a portion of said forced air flow is introduced into said oven cavity through said aperture;

damper means for selectively closing said aperture formed in said oven wall for precluding the introduction of said forced air flow into said oven cavity; and a damper drive system for selectively placing said damper means in a closed condition and an open state, said damper drive system including:

a damper motor having a drive shaft; means for rotating said drive shaft of said damper motor;

transfer means for transferring the rotation of said drive shaft of said damper motor to said damper means;

switch means operatively connected to said transfer means for selectively being turned off and on;

detection means for sensing a voltage indicative of said switch means being in said on position and developing a first detection signal when said damper means is in the closed condition, and for sensing a voltage indicative of said switch means being in said off position and developing a second detection signal when said damper means is in the open state; and a motor drive unit for terminating the rotation of said drive shaft of said damper motor when said first detection signal or said second detection signal is developed.

2. The cooking apparatus of claim 1, said transfer means comprising:

a damper cam secured to said drive shaft of said damper motor; and a damper link disposed between said damper cam and said damper means.

3. The cooking apparatus of claim 2, wherein said damper cam includes:

a large diameter semicircular portion; and a small diameter semicircular portion.

4. The cooking apparatus of claim 3, said switch means comprising a normally close microswitch disposed near said damper cam, said normally close microswitch being switched off when said large diameter semicircular portion faces said normally close microswitch.

5. The cooking apparatus of claim 4, wherein said first detection signal is developed in response to a leading edge of a switching operation of said normally close microswitch from the OFF state to the ON state, and said detection signal is developed in response to a trailing edge of a switching operation of said normally close microswitch from the ON state to the OFF state.

6. A damper drive system for selectively placing a damper in the closed condition and the open state, comprising:

a damper motor having a drive shaft; means for rotating said drive shaft of said damper motor;

transfer means for transferring the rotation of said drive shaft of said damper motor to said damper;

switching means associated with said transfer means, said switching means being placed in a first condition when said damper is tightly closed and in a second condition when said damper is placed in the full-open state;

detection means for sensing a voltage indicative of said switching means being in an on position or an off position and for detecting the switching operation of said switching means from said first condition to said second condition or from said second condition to said first condition; and motor drive control means for terminating the rotation of said drive shaft said damper motor when said detection means detects said switching operation of said switching means.

7. The damper drive system of claim 6, said transfer means comprising:

a damper cam secured to said drive shaft of said damper motor; and a damper link disposed between the damper and said damper cam.

8. The damper drive system of claim 7, said switching means comprising a normally close microswitch disposed near said damper cam so that said normally close microswitch is switched off when a preselected portion of said damper cam faces said normally close microswitch, wherein said detection means detects the trailing edge or the leading edge of an output signal derived from said normally close microswitch.

* * * * *